United States Patent [19]

Portnoy

[11] 4,360,394

[45] Nov. 23, 1982

[54] PRODUCTION OF FINE-GRAINED CAST CHARGES WITH UNORIENTED CRYSTAL STRUCTURE OF TNT OR EXPLOSIVE COMPOSITIONS CONTAINING TNT

[75] Inventor: Seymour Portnoy, Livingston, N.J.

[73] Assignee: The United States of America as represented by the Secretary of the Army, Washington, D.C.

[21] Appl. No.: 230,225

[22] Filed: Feb. 2, 1981

[51] Int. Cl.[3] ..... D03D 23/00

[52] U.S. Cl. ..... 149/109.6; 149/18; 149/105; 264/3 R

[58] Field of Search ..... 264/3 R; 149/18, 105, 149/109.6

[56] References Cited

U.S. PATENT DOCUMENTS 3,734,983 5/1973 Forster et al. ..... 149/105 X 3,766,820 10/1973 Forster et al. ..... 149/105 X

*Primary Examiner*—Stephen J. Lechert, Jr.

*Attorney, Agent, or Firm*—Nathan Edelberg; Robert P. Gibson; A. Victor Erkkila

[57] ABSTRACT

An effective amount of 5-nitrobarbituric acid or its trihydrate, when mixed with molten TNT explosive permits the TNT explosive to set with a fine unoriented crystal structure. In one embodiment, the 5-nitrobarbituric acid or its trihydrate is added to well-stirred liquid TNT at about 100°-110° C. and the mixture is allowed to cool until it stiffens and then is reheated slightly below 85° C. and then cast at about 81° C.

4 Claims, No Drawings

PRODUCTION OF FINE-GRAINED CAST CHARGES WITH UNORIENTED CRYSTAL STRUCTURE OF TNT OR EXPLOSIVE COMPOSITIONS CONTAINING TNT

The present invention relates to producing fine unoriented crystalline cast charges of 2,4,6-trinitrotoluene. As a result of the fine unoriented crystalline structure, the problems with cracking are reduced.

TNT is widely used as a cast explosive for shells and bombs, etc. Normally, TNT is heated above its melting point and poured in a container such as a shell or a bomb where it is allowed to solidify into a solid charge. It has been observed that when TNT is thus cast, relatively large needle-shaped crystals are formed with their longitudinal axes at right angles to the cooling surface. That is, in a cylindrical casing, such large needle-shaped crystals tend to form from the outside toward the center. When such a casting is sawed, the characteristic pattern of needle-formed straight lines from the periphery to the center is easily seen.

Such large oriented crystals permit cracking of the cast charge due to the fact that the crystals of TNT have approximately a four times higher coefficient of longitudinal expansion along their shorter axis than along the longer one. Cracks thus occur parallel with the long axis of the crystals as the charge is cooling.

This presents a particular problem in casts having cracks, particularly in the rear of the shell where the great accelerations that arise from firing a shell lead to bursts in the bore from unintentional initiation of the explosive by impact or by adiabatic compression.

Attempts have been made to reduce the crystal size and orientation in a TNT charge. For example, fine particles of TNT have been added to the mixture just before pouring to provide additional crystalization nuclei. This technique, although it may be successful in reducing crystal size and orientation, requires unusually close control of temperature and suffers from increased viscosity of the melt which may make pouring a problem.

Another method disclosed in U.S. Pat. No. 3,620,857 employs 2,2',4,4',6,6'-hexanitrostilbene which is added to the melt from which the charge is made. This material tends to provide additional crystalization nuclei and results in a satisfactory charge having fine unoriented crystals. The hexanitrostilbene suffers from the disadvantage that it is both scarce and expensive and, although it is used as a relatively small precentage of the charge, increases the cost of charge.

According to the present invention, the desired properties of fine unoriented crystals are achieved by adding a small but effective amount of 5-nitrobarbituric acid or its trihydrate product to molten TNT before casting. The cast product is found to be free of cracks and to have properties which are comparable to those achieved with the scarcer and more expensive 2,2',4,4',6,6'-hexanitrostilbene.

The exact percentage of 5-nitrobarbituric acid or the trihydrate thereof required to form an effective amount may be determined by one skilled in the art. A percentage of between 0.5 and 2% based on the weight of the TNT is believed to represent the optimum range.

EXAMPLE I

Approximately 0.5% by weight of 5-nitrobarbituric acid trihydrate is added to well-stirred liquid TNT heated to about 100–110° C. The homogeneous melt is allowed to cool until it stiffens and then it is reheated to slightly below 85° and then cast at about 81°. A cast of small unoriented TNT crystals was obtained thereby. In comparison, a cast made in a like manner with an equivalent quantity of 2,2',4,4',6,6'-hexanitrostilbene indicates that the present invention produces casts of similar quality.

Having described a specific embodiment of the invention, it is to be understood that the invention is not limited to this precise embodiment, and that various changes and modifications may be effected therein by one skilled in the art without departing from the scope or spirit of the invention as defined in the appended claims.

I claim:

1. A method of producing cast charges of 2,4,6-trinitrotoluene having small unoriented crystal structure comprising adding an effective amount of one of 5-nitrobarbituric acid and the trihydrate thereof to a melt from which the cast charges are made.

2. A method according to claim 1, wherein said 5-nitrobarbituric acid is the trihydrate thereof.

3. A method according to claim 1, wherein said effective amount is between 0.5 and 2% by weight of 2,4,6-trinitrotoluene.

4. A method according to claim 1, further comprising heating a melt containing 2,4,6-trinitrotoluene to a temperature of between 100° and 110° C., stirring one of the 5-nitrobarbituric acid and its trihydrate into the liquid 2,4,6-trinitrotoluene, cooling the mixture until it stiffens and then reheating the mixture to a temperature slightly below 85° C., cooling and casting the mixture.

* * * * *